US006373192B1

(12) United States Patent
Morimoto et al.

(10) Patent No.: US 6,373,192 B1
(45) Date of Patent: Apr. 16, 2002

(54) DIELECTRIC BARRIER DISCHARGE LAMP AND IRRADIATION DEVICE

(75) Inventors: Yukihiro Morimoto, Mishima; Shigenori Nozawa, Himeji; Masashi Okamoto, Akashi, all of (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/492,835

(22) Filed: Jan. 27, 2000

(51) Int. Cl.[7] ..... H01J 17/16; H01J 65/00; H01J 11/00

(52) U.S. Cl. ..... 313/607; 313/231.71; 313/573; 313/234; 313/493; 313/594; 313/636

(58) Field of Search ..... 313/364, 621, 313/607, 231.71, 36, 573, 575, 40, 234, 631, 493, 112, 574, 594, 636

(56) References Cited

U.S. PATENT DOCUMENTS

| | | | | |
|---|---|---|---|---|
| 4,837,484 A | | 6/1989 | Eliasson et al. | |
| 4,983,881 A | * | 1/1991 | Eliasson et al. | 313/234 X |
| 5,006,758 A | * | 4/1991 | Gettert et al. | 313/607 X |
| 5,214,344 A | * | 5/1993 | Kogelschatz | 313/607 X |
| 5,283,498 A | * | 2/1994 | von Arx et al. | 313/634 X |
| 5,670,844 A | | 9/1997 | Ysudaa et al. | |

FOREIGN PATENT DOCUMENTS

| | | | |
|---|---|---|---|
| DE | 44 32 315 A | 3/1996 | |
| DE | 196 02 924 | 7/1997 | |
| EP | 0 944 109 | 9/1999 | |
| GB | 2 171 214 | 8/1986 | |
| JP | 0309551 | * 12/1990 | 313/234 |

OTHER PUBLICATIONS

G. Hetherington & K.H. Jack, Water in Vitreous Silica, Part I. Influence of 'water' Content on the Properties of Vitreous Silica, Physics and Chemistry of Glasses, vol. 3, No. 4, Aug. 1962, pp. 129–133, XP–000907613.

Patent Abstracts of Japan, vol. 017, No. 566 (E–1446), Oct. 13, 1993, & JP 05 166489 A (Ushio Inc.), Jul. 2, 1993, English Abstract.

Database WPI, Section PQ, Week 199625, Derwent Publications LTD., London, GB; Class P75, AN 1996–248951, XP002133113, & JP 08 102287 A, Toshiba Lightech KK, Apr. 16, 1996, English Abstract.

* cited by examiner

*Primary Examiner*—Ashok Patel
(74) *Attorney, Agent, or Firm*—Nixon Peabody LLP; David S. Safran

(57) ABSTRACT

A dielectric barrier discharge lamp with a translucent part made of silica glass which contains OH radicals and in which damage of the silica glass by UV radiation can be suppressed and a sufficient amount of UV radiation can be obtained in a dielectric barrier discharge lamp, in which a silica glass discharge vessel is filled with a discharge gas which forms excimer molecules by a dielectric barrier discharge and which is at least partially provided with a translucent part, by the translucent part having a ratio of non-hydrogen bonding OH radicals to the total number of OH radicals which is less than or equal to 0.36.

2 Claims, 3 Drawing Sheets

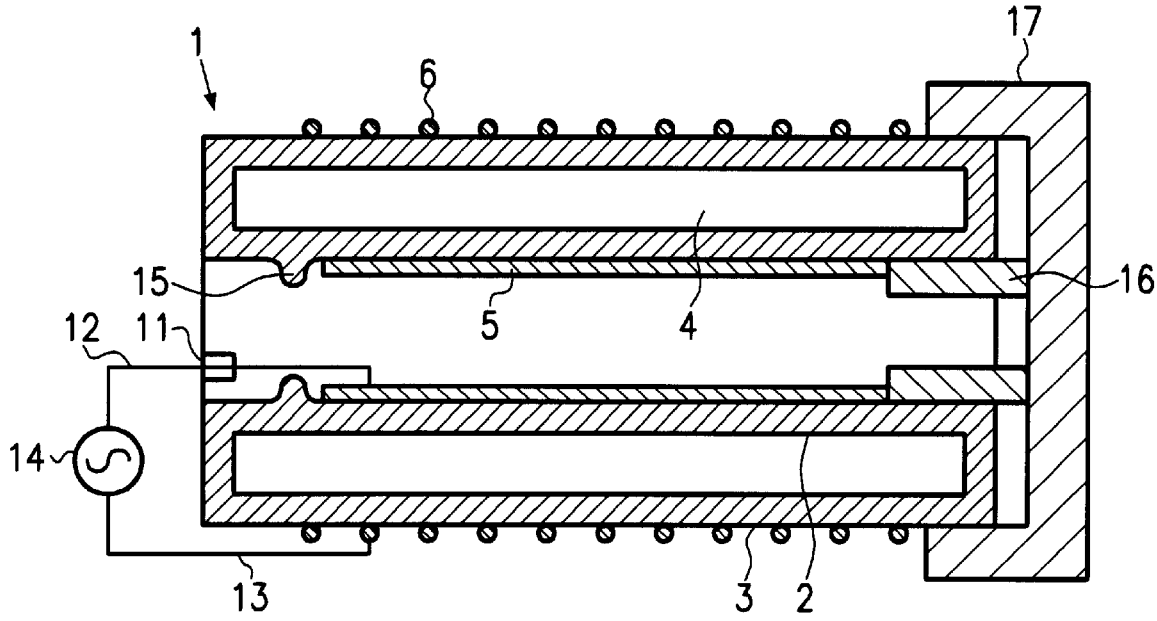
Fig.1
Fig.2(a)
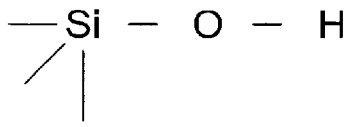
Fig.2(b)
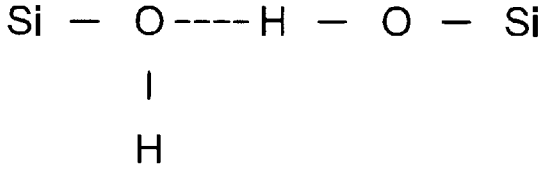
Fig.2(c)
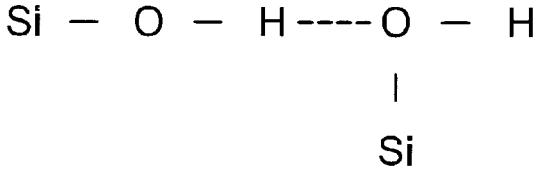

| | Main wave number ($cm^{-1}$) | Scattering |
|---|---|---|
| 1 | 3694 | 18 |
| 2 | 3661 | 24.5 |
| 3 | 3612 | 41 |
| 4 | 3551 | 58 |
| 5 | 3426 | 110 |

DIELECTRIC BARRIER DISCHARGE LAMP AND IRRADIATION DEVICE

BACKGROUND OF THE INVENTION

1. Field of the Invention

The invention relates to a dielectric barrier discharge lamp in which a dielectric barrier discharge forms "excimer" molecules and in which light is used which is emitted by these "excimer" molecules. The invention furthermore relates to an irradiation device in which this dielectric barrier discharge lamp is used as a light source. The invention relates especially to silica glass as the translucent part of a dielectric barrier discharge lamp or a window component of an irradiation device.

2. Description of Related Art

A radiator, i.e., a dielectric barrier discharge lamp in which a discharge vessel is filled with a gas which forms excimer molecules and in which light is emitted which has been radiated by a dielectric barrier discharge of the excimer molecules, is known generally, for example, from the Japanese patent disclosure document HEI 1-144560 or U.S. Pat. No. 4,837,484.

This dielectric barrier discharge lamp is also called an ozone production discharge or a silent discharge, as is described in the "Discharge Handbook," Electroassociation, June 1989, 7th edition, page 263, Japan.

In the aforementioned publications, it is described that a discharge vessel with a roughly cylindrical shape acts at least partially as a dielectric of the dielectric barrier discharge and is translucent, and in it the light is emitted by excimer molecules. Furthermore, it is disclosed herein that silica glass is to be used as the dielectric for passage of light.

One such dielectric barrier discharge lamp has advantages which neither a conventional low pressure mercury lamp, nor a conventional high pressure arc discharge lamp has, such as, for example, emission of UV radiation with a short main wavelength of 172 nm, and at the same time, selective generation of light with individual wavelengths which are somewhat like line spectra, with high efficiency. Furthermore, there is the advantage that a commercial dielectric barrier discharge lamp can be used and it can also be produced easily if silica glass is used as the dielectric and light passage window, as was described above.

It is known that damage by the emitted UV radiation can be reduced when this silica glass contains a suitable number of OH radicals (hydroxyl group), as if the silica glass consists of pure silicon dioxide ($SiO_2$).

Therefore, it is more advantageous if the silica glass contains OH radicals. If the content thereof becomes too great, however, there is the disadvantage that, as a result of absorption of the UV radiation by the OH radicals themselves, the desired amount of radiation soon can no longer be obtained. Conversely, in the case that the content of OH radicals is too low, damage by UV radiation occurs; this causes degradation of the silica glass or similar problems.

SUMMARY OF THE INVENTION

Therefore, a primary object of the present invention is to devise a dielectric barrier discharge lamp with a translucent part made of silica glass which contains OH radicals.

A further object of the invention is to devise an irradiation device in which a dielectric barrier discharge lamp is used as the light source and the silica glass which contains OH radicals is used as the window component.

Another object of the invention is, thus, to advantageously suppress damage of the silica glass by UV radiation and to obtain a sufficient amount of UV radiation.

In a dielectric barrier discharge lamp in which a silica glass discharge vessel is filled with a discharge gas which forms excimer molecules by a dielectric barrier discharge and in which this discharge vessel is at least partially provided with a translucent part, the above objects are achieved in accordance with the invention in that, in this translucent part, the ratio of the non-hydrogen bonding OH radicals to the total number of OH radicals is less than or equal to 0.36.

The stated objects are, furthermore, achieved according to the invention in an irradiation device with at least one dielectric barrier discharge lamp and a window component in that the window component is made of silica glass, and in the window component, the ratio of the non-hydrogen bonding OH radicals to the total number of OH radicals is at most equal to 0.36, in which in at least one dielectric barrier discharge lamp in the discharge vessel excimers are produced and UV radiation is emitted by a dielectric barrier discharge, and in which the window component and at least one dielectric barrier discharge lamp are arranged such that the UV radiation of at least one dielectric barrier discharge lamp emerges from the window component.

In the following, the invention is specifically described using one embodiment shown in the drawings.

BRIEF DESCRIPTION OF THE DRAWINGS

FIG. 1 shows a schematic of a dielectric barrier discharge lamp as claimed in the invention, FIGS. 2(*a*) to 2(*c*) each show a schematic of the non-hydrogen bonding OH radicals in the invention;

DETAILED DESCRIPTION OF THE INVENTION

Figure 3:
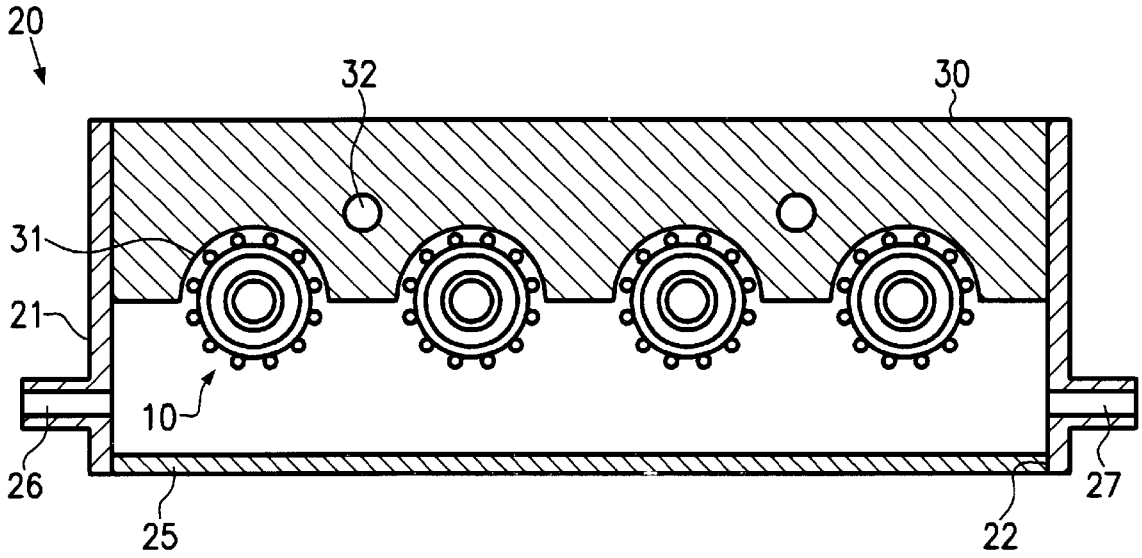
FIG. 3 is a cross-sectional view of an irradiation device according to the invention.

FIG. 1 schematically shows a specific example of a dielectric barrier discharge lamp in accordance with the invention. In the figure, a discharge vessel 1 has a coaxial, double tube arrangement having an inner tube 2 and an outer tube 3 of silica glass. The two ends of the inner tube 2 and the outer tube 3 are sealed and between them an annular discharge space 4 is formed which is filled with xenon gas as the discharge gas, for example, with a pressure of 40 kPa.

The inner tube 2 is provided with an inner electrode 5 which is a light reflector plate and acts as an electrode of the dielectric barrier discharge lamp. This inner electrode is made, for example, of aluminum and is tubular. It has a total length of 300 mm, an outside diameter of 16 mm and a thickness of 1 mm. The outer tube 3 acts both as a dielectric of the dielectric barrier discharge lamp and also as a light exit window. Its outside surface is provided with an outer electrode 6. The outer tube 3 has an outside diameter of 24.5 mm and a thickness of 1 mm.

The outer electrode 6 is made of a metal wire mesh that is seamlessly and cylindrically knitted, and the discharge vessel 1 is inserted therein. Light can be emitted through the mesh. In the discharge space 4, there is a getter with barium as the main component. This getter eliminates gaseous contamination (for example, water) in the discharge space 4 and stabilizes the discharge.

A line which is connected to the high voltage line 12 via a compression attachment component 11 is connected to the inside electrode 5. The outer electrode 6 is provided with a low voltage line 13. The high voltage line 12 and the low voltage line 13 are connected to a power source 14. The low voltage line 13 is grounded as necessary. In the inner tube 2, a projection 15 is formed as a component for preventing movement of the inner electrode 5. On the side opposite the projection 15 there are a component 16 for prevention of movement and a base 17.

The dielectric barrier discharge lamp is treated in such a way that the silica glass of the inner tube 2 or the outer tube 3, at least in the translucent part, has a concentration of the non-hydrogen bonding OH radicals in a constant range. The reason for this is that by controlling the concentration of the non-hydrogen bonding OH radicals, the transparency can be greatly increased at a wavelength of 160 nm.

In the following these matters are further described.

As a result of various studies, the inventors have ascertained that of the OH radicals which are contained in the silica glass, the non-hydrogen bonding OH radicals have an intimate relationship to this phenomenon. Thus, they have overturned conventional common sense that in any case absorption of UV radiation takes place by the OH radicals themselves when silica glass contains OH radicals (for example, as is disclosed in "J. Spectrosc. Society Jap., vol. 41, 2 (1992) B1" that OH radicals in silica glass absorb light with a wavelength of less than or equal to 168 nm). Hydrogen bonding OH radicals do not greatly absorb UV light, especially VUV light. In a dielectric barrier discharge lamp which emits VUV light, and in an irradiation device in which this dielectric barrier discharge lamp is used as the light source, therefore, the absorption of the VUV light by the silica glass itself can be advantageously suppressed by reducing the concentration of the non-hydrogen bonding OH radicals as much as possible in the silica glass which comprises the translucent part and the light transmitting window and the concentration of hydrogen bonding OH radicals is maintained to a certain extent. Thus, damage by VUV radiation can be reduced.

In this case, the expression "non-hydrogen bonding OH radical" is defined as a radical in which the bonding of the OH radical takes place only with silicon (Si) (FIG. 2(*a*)) and which does not form any hydrogen bond. FIG. 2(*b*) and FIG. 2(*c*), conversely, show, for example, radicals which form a hydrogen bond; this is shown using the broken line.

The OH radicals in silica glass at a wavelength of 27.1 microns (at an oscillating frequency of 3672 $cm^{-1}$) have a wide absorption band as is described in several publications (for example, in Phys. Chem. Glasses, 3 (1962)129, J. Non-Crystal. Solid, 139 (1992)35)). The latter publication states that this absorption band originates from two different OH radical types, i.e., in the above described broad absorption band on the side of the high frequency range of the non-hydrogen bonding OH radicals (molecular structure formula in FIG. 2(*a*)), and on the side of the low frequency range of hydrogen bonding OH radicals (molecular structure formula in FIGS. 2(*b*) and 2(*c*)).

Using the fact that, in this way, in the absorption band with an oscillating frequency of 3672/$cm^{-1}$, the presence of non-hydrogen bonding OH radicals and hydrogen bonding OH radicals can be read, the inventors have developed the following process for measuring the concentration ratios of the two OH radicals to one another.

To measure the concentration ratio of the above described two OH radicals, of the OH radicals contained in the silica glass first a broad absorption band with an oscillating frequency 3672 $cm^{-1}$ was finely divided. Five absorption bands (called "element bands"), which are represented by the Gaussian distribution were assumed, and a process established in which the intensity of the element bands is set in such a way that it agrees as much as possible with the wide absorption band with an oscillating frequency 3672 $cm^{-1}$, in which the sum of these five element bands was subjected to IR transmission spectrum measurement.

These matters are further described below.

The Gaussian distribution is generally represented as follows:

$$Ix=(C/\sigma\sqrt{\pi})\exp(-(x-y)^2/2\,\sigma^2)$$

Figures 5, 6:
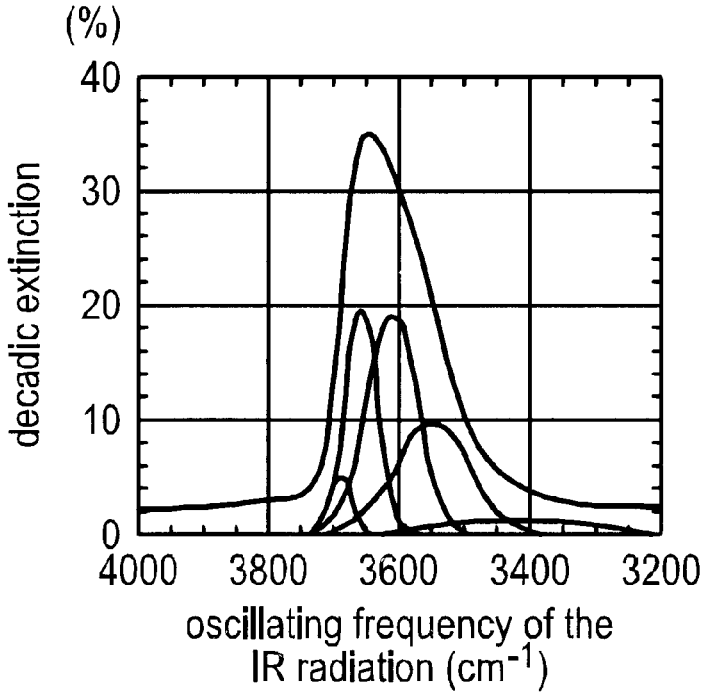
FIG. 5 is a chart for determining the ratio of the non-hydrogen bonding OH radicals.
FIG. 6 is a graph for determining the proportion of the non-hydrogen bonding OH radicals.

Here C is a coefficient, x is the oscillating frequency, σ is the scattering, and y is the main wave number of the element bands. The main wave number of the five element bands and the straggling are adjusted in each case to the values which are shown in FIG. 5. Here, C which decides the intensity is set in a suitable manner such that it agrees as much as possible with the absorption band with oscillating frequency of 3672 $cm^{-1}$ in which the sum of the five element bands was measured. In the figure, the non-hydrogen bonding OH radicals correspond to the element bands 1 and 2 and the hydrogen bonding OH radicals correspond to element bands 3, 4, and 5.

FIG. 6 shows the waveforms of the five element bands, the x-axis plotting the oscillating frequency of the IR radiation and the y-axis plotting the light absorption by the silica glass. Based on the five element bands determined in this way the non-hydrogen bonding OH radicals are determined. The ratio of the non-hydrogen bonding OH radicals to the total number of OH radicals is determined by the sum of the areas of element bands 1 and 2 (shown using the broken line) (i.e., the sum of the element bands of the non-hydrogen bonding OH radicals) being divided by the area of the wide absorption band with an oscillating frequency of 3672 $cm^{-1}$. Here, the expression "area of the absorption band with the oscillating frequency 3672 $cm^{-1}$" is defined as the area which was determined in the range from 3200 $cm^{-1}$ to 3770 $cm^{-1}$ with respect to the absorption band with the oscillating frequency of 3672 $cm^{-1}$, the straight line between the value of the absorption band at an oscillating frequency of 4000 $cm^{-1}$ and the value of the absorption band at an oscillating frequency of 3000 $cm^{-1}$ being called the baseline (this baseline is also called the zero line and the light intensity of less than or equal to the baseline is riot added on).

To evaluate how large the concentration of the non-hydrogen bonding OH radicals of any silica glass is relative to the total concentration of OH radicals, the waveforms of the element bands as shown in FIG. 6, and thus the above described area ratio, can be determined.

Figure 4:
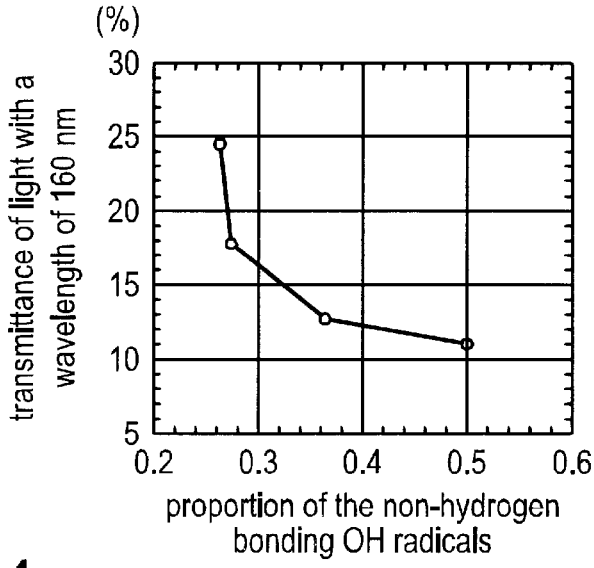
FIG. 4 is a graph depicting the relation between the non-hydrogen bonding OH radicals and the amount of UV radiation passed.

In the following, the relation between the proportion of the non-hydrogen bonding OH radicals and the concentration of all the OH radicals and the amount of transmission of the UV radiation are shown. In FIG. 4, the y-axis plots the transmittance (%) of the light with a wavelength of 160 nm and the x-axis plots the relative concentration of the non-hydrogen bonding OH radicals.

It follows from the drawings that the transmittance of the VUV light, the light with a wavelength of 160 nm, is greater than or equal to 13% when the concentration of the non-hydrogen bonding OH radicals in the silica glass is less than 0.36. In the case of the concentration of the non-hydrogen bonding OH radicals of less than 0.30, the transmittance is greater than or equal to 16%. In the case of a concentration of OH radicals of greater than or equal to 0.27, the transmittance is greater than or equal to 18%. Therefore, it becomes apparent that the transmittance increases rapidly.

To reduce the concentration of the content of the non-hydrogen bonding OH radicals in the silica glass, there is a process in which the silica glass is irradiated with gamma rays which are emitted by a gamma radiation source, such as, for example, 100-hour irradiation of a commercial silica glass with gamma radiation. Furthermore, another suitable process can be one in which the silica glass is heated in a wet atmosphere (with a water partial pressure of, for example, $4.6\times10^4$ Pa) and at a relatively low temperature, for example, 350° C. The reason for this is presumably that the bond state with respect to silicon hydroxide (SiOH) in the silica glass is changed by this treatment process.

The concentration of the non-hydrogen bonding OH radicals which are contained in the silica glass can be established in the above described range by one such treatment being carried out during or after installation of the dielectric barrier discharge lamp.

In the test shown above using FIG. 4, the ratio of the non-hydrogen bonding OH radicals before treatment to the total amount of OH radical was 0.50 and the transmittance of light with a wavelength of 160 nm was 11%.

FIG. 3 shows an irradiation device in accordance with the invention. In the figure, a box-like lamp housing 20 with a rectangular overall shape contains four dielectric barrier discharge lamps 10 which emit VUV light.

The lamp housing 20 is provided with a rectangular cylindrical casing 21 in which a window component 25 for emergence of VUV light from the dielectric barrier discharge lamp 10 to the outside is located, so that an opening 22 is hermetically sealed on the bottom of the casing. Furthermore, a cooling block 30 of aluminum is arranged such that an opening on the top of the casing 21 is sealed. The window component 25 is made of silica glass which is translucent with respect to the VUV light from the dielectric barrier discharge lamps 10. On one side of the casing 21, a gas inlet opening 26 for introducing inert gas into the lamp housing 20 is formed.

On the other side of the casing 21, a gas outlet opening 27 for releasing the gas is formed in the lamp housing.

On the bottom surface of the cooling block 30 in the lamp housing 20, there are four grooves 31 with a semicircular cross section and a larger outside diameter than the outside diameter of the respective dielectric barrier discharge lamp 10 are located at a spacing relative to one another. Along the respective groove 31, there is a dielectric barrier discharge lamp 10. Furthermore, a passage 32 for cooling fluid penetrates the cooling block 30.

In an irradiation device using the dielectric barrier discharge lamp with such an arrangement, the ratio of the non-hydrogen bonding OH radicals of the window component 25 to the total number of OH radicals is fixed as less than or equal to 0.36.

Action of the Invention

In the dielectric barrier discharge lamp in accordance with the invention, the discharge vessel is provided at least partially with a translucent part, in which the ratio of the non-hydrogen bonding OH radicals to the total number of OH radicals is fixed at less than or equal 0.36. This measure can advantageously suppress the damage of the silica glass by UV radiation, and at the same time, a sufficient amount of UV radiation, especially the light on the side of the short wavelengths of the xenon excimer radiation band, is adequately obtained.

In the irradiation device according to the invention, the ratio of the non-hydrogen bonding OH radicals of the window component from which the UV radiation of the dielectric barrier discharge lamp emerges, to the total number of OH radicals, is fixed at less than or equal to 0.36. Likewise, in this way, damage of the silica glass by UV radiation can be advantageously suppressed, and at the same time, a sufficient amount of UV radiation, especially the light on the side of the short wavelengths of the xenon excimer radiation band, is adequately obtained.

What we claim is:

1. Dielectric barrier discharge lamp, comprising a silica glass discharge vessel filled with a discharge gas which forms excimer molecules by a dielectric barrier discharge and which is at least partially provided with a translucent part; wherein the translucent part has a ratio of non-hydrogen bonding OH radicals to a total number of OH radicals which is at most equal to 0.36.

2. Irradiation device comprising at least one dielectric barrier discharge lamp and a window component, the at least one dielectric barrier discharge lamp having a discharge vessel in which excimers are produced and UV radiation being emitted by a dielectric barrier discharge; wherein the window component and the at lest one dielectric barrier discharge lamp are arranged such that the UV radiation of the at least one dielectric barrier discharge lamp emerges through the window component; and wherein the window component is made of silica glass in which a ratio of the non-hydrogen bonding OH radicals to a total number of OH radicals is at most equal to 0.36.

* * * * *